US006261070B1

(12) United States Patent
Johnson

(10) Patent No.: US 6,261,070 B1
(45) Date of Patent: Jul. 17, 2001

(54) IN-LINE ELECTRIC MOTOR DRIVEN COMPRESSOR

(75) Inventor: Anders T. Johnson, Cypress, TX (US)

(73) Assignee: El Paso Natural Gas Company, Houston, TX (US)

( * ) Notice: Subject to any disclaimer, the term of this patent is extended or adjusted under 35 U.S.C. 154(b) by 0 days.

(21) Appl. No.: 09/365,362

(22) Filed: Jul. 30, 1999

Related U.S. Application Data

(60) Provisional application No. 60/100,694, filed on Sep. 17, 1998.

(51) Int. Cl.[7] ..... F04B 17/00
(52) U.S. Cl. ..... 417/366
(58) Field of Search ..... 417/366, 360, 417/307, 310, 423.1, 423.3; 60/331

(56) References Cited

U.S. PATENT DOCUMENTS 3,705,775 * 12/1972 Rioux ..... 417/411
4,125,345 * 11/1978 Yoshinga et al. ..... 60/9.36
4,389,842 * 6/1983 Behnert ..... 417/243
4,834,624 * 5/1989 Jensen et al. ..... 417/370
5,819,524 * 10/1998 Bosley et al. ..... 60/39.465

* cited by examiner

*Primary Examiner*—Teresa Walberg
*Assistant Examiner*—Vinod D Patel
(74) *Attorney, Agent, or Firm*—Locke Liddell & Sapp LLP

(57) ABSTRACT

The present invention relates to an in-line electric motor driven compressor station that uses an in-line electric motor driven compressor to transport gas through a pipeline. This station can operate with greater flexibility and reduce costs because either axial or centrifugal compressors can be used, the motor can be immersed in the gas stream or cooled by air, and the station can actually be used to generate electricity. While overcoming the deficiencies of conventional compressor stations, an in-line electric motor driven compressor station offers operators a longer lasting, improved way to maintain the necessary pressures in a gas pipeline.

19 Claims, 9 Drawing Sheets

IN-LINE ELECTRIC MOTOR DRIVEN COMPRESSOR

CROSS-REFERENCES TO RELATED APPLICATIONS

This application claims the benefit of U.S. Provisional Application No. 60/100,694, filed Sep. 17, 1998.

FIELD OF THE INVENTION

This invention relates generally to the field of gas compressor systems. In particular, it relates to compressor systems for transporting natural gas to compressor systems using an in-line compressor. In addition to natural gas, the invention relates to the compression of any clean, dry gas service, i.e., air, nitrogen, hydrogen, etc.

BACKGROUND OF THE INVENTION

The gas pipelines in use throughout the world transport billions of cubic feet of natural gas every day, at pressures in excess of 750 PSIG. As the gas is forced through these pipelines, friction occurs. Friction results in pressure loss, which results in a loss of capacity and lost sales opportunities. To minimize the loss due to frictional pressure drop, traditional pipeline companies install large booster compressor stations.

The natural gas transmission systems were originally designed with thousands of miles of pipe, utilizing compressor stations at 80 mile intervals to boost the gas pressure. As system capacity requirements increased, intermediate stations were installed, shortening the distance between stations to 40 miles. The distance between stations represents the industry's attempt to balance compressor station costs, pipeline costs, and available capacity. With costs exceeding $40 million for a typical station, most companies could not economically justify locating their stations closer together.

Compressor stations boost a pipeline's capacity by increasing the pressure. Increasing pressure increases the gas density, which allows the same quantity of energy to occupy less space. Maintaining high pressure helps in two ways: higher pressures create denser gas that requires less space and flows at a lower velocity, thus introducing less friction in the pipeline and lessening the pressure drop for equivalent gas energy packets; and denser gas allows more gas to be packed into the pipeline.

Packing is very important to pipelines. If a pipeline operator knows that the demand in the morning is going to be higher than what the company can normally deliver, the operator can "pack" the line the night before, storing extra gas in the line. This pack allows the customer to draw down the pressure. Therefore, it is advantageous to keep the pressure as high as possible for as long as possible.

Due to the pressure losses that occur along the length of a natural gas pipeline, compressor stations are needed at various intervals to maintain the pressure and flow of natural gas through the pipeline. Typical compressor stations use gas power engines to drive the compressors. These compressor stations suffer from numerous disadvantages. For example, compressors are not efficient when partially loaded and tend to generate significant amounts of noise in the surrounding environment. Additionally, conventional compressors are very sensitive to stops and starts. Therefore, numerous starts and stops can significantly reduce the useful life of the unit.

Moreover, conventional compressors are difficult to replace in the event of a failure. During an outage, pipeline companies tend to repair engines in place, causing down time for the pipeline. Furthermore, conventional compressors are rarely interchangeable. If the pipeline operator chooses to change equipment or modify the plant's piping, the operator is usually limited to the unique footprint of that equipment. Thus, unless the operator is willing to scrap the existing equipment, it would be impractical to modify or change conventional compressors. In addition, emissions from gas-driven compressors continue to be an increasingly greater problem when trying to comply with increasingly strenuous environmental regulations.

FIG. 5 is an example of a conventional compressor station. The compressor station comprises underground gas pipeline 100 through which gas flows from left to right as indicated by the arrow. Blocking valve 102 is provided to prevent the gas from flowing in a circular pattern. and is normally closed when the station is operating. On the upstream side of pipeline 100 is a suction header 104. The suction header 104 contains various piping components that are conventional in the art such as station block valve 105 and scrubber 107. The suction header 104 supplies gas to the centrifugal compressor 116 which is driven by motor 114. In order to duct the gas to the compressor 116, there is provided a 45° elbow 106 which feeds a rolled 90° elbow 108. On the output side of compressor 116 similar piping is provided. The output flows through rolled 90° elbow 110 and then through 45° elbow 112 in the discharge header 118 and finally reenters the pipeline 100. One problem with the conventional compressor station shown in FIG. 5 is that there is a pressure loss due to the friction of the gas in the pipelines going through bends, such as the 90 and 45° elbows. Therefore, it is desirable to eliminate these elbows in a compressor station. Also, since the gas enters the compressor 116 at a right angle to the shaft of motor 114 there is a chance that piping forces could be imparted on the intake or output nozzles of the compressor 116. This can cause casing distortion to the compressor 116 and damage the compressor and motor 114. It can also cause misalignment of the motor 114 and the compressor 116 which causes vibration in the compressor station. This vibration can, in turn, cause the compressor to shut down and wear out mechanical components prematurely. Further, this misalignment makes it difficult to adequately seal the compressor 116. Because of maintenance issues, conventional compressor stations are typically constructed in buildings above ground which require additional space and costs for the station. The building also must be insulated to reduce noise. The same problems occur in a variety of gas compression systems and are not limited to natural gas compressor stations.

Though the previous examples represent some of the major deficiencies of conventional compressor stations, this list is by no means exhaustive.

The present invention overcomes these deficiencies and provides further improvements and advantages which will become apparent in view of the following disclosure.

SUMMARY OF THE INVENTION

One aspect of the present invention relates to In-line electric motor driven compressor stations that use In-line Electric Motor Driven Compressors ("IEMDCs") to transport gas through a pipeline. This avoids the piping bends in conventional compressor stations that cause pressure loss and other problems discussed earlier. The compressor can be either axial, centrifugal, or fan. Also, the In-line compressor can be mounted above or below ground. In one advantageous embodiment, the compressor is optimized for a compression ratio of about 1.1:1 to about 1.3:1. The motor can be immersed in the gas stream, thus cooled by the flowing gas, or can be mounted outside the gas stream, and cooled by air. If the motor is mounted in the gas stream, both the motor and the compressor can have a plurality of magnetic bearings, which make the compressor station virtually maintenance free and environmentally friendly because there are no conventional compressor seals to leak gas to the atmosphere.

IEMDCs as used in conjunction with the teachings of the invention overcome a variety of the deficiencies in the conventional compressor stations. First, an IEMDC is less sensitive to stops and starts. The operator can run the system only when required and shut it down without worry of significantly shortening the life of the unit. Additionally, because a failed unit can be quickly removed and replaced with a spare or a pipe spool, pipelines will not suffer the significant outages caused by repairing conventional compressors in place. Moreover, pipeline companies will have the option to choose from a variety of vendors' compressors, allowing them to modify equipment or insert a pipe spool. In addition, In-line compressor stations offer reduced emissions, full automation, quieter operation, improved safety, a reduction of surface space needed to house the compressor and shortened installation time as well as less of a hazard to the public.

Second, IEMDCs can be used to generate electricity without significantly degrading the overall flow of gas in the pipeline.

DETAILED DESCRIPTION OF PREFERRED EMBODIMENT

Figure 1:
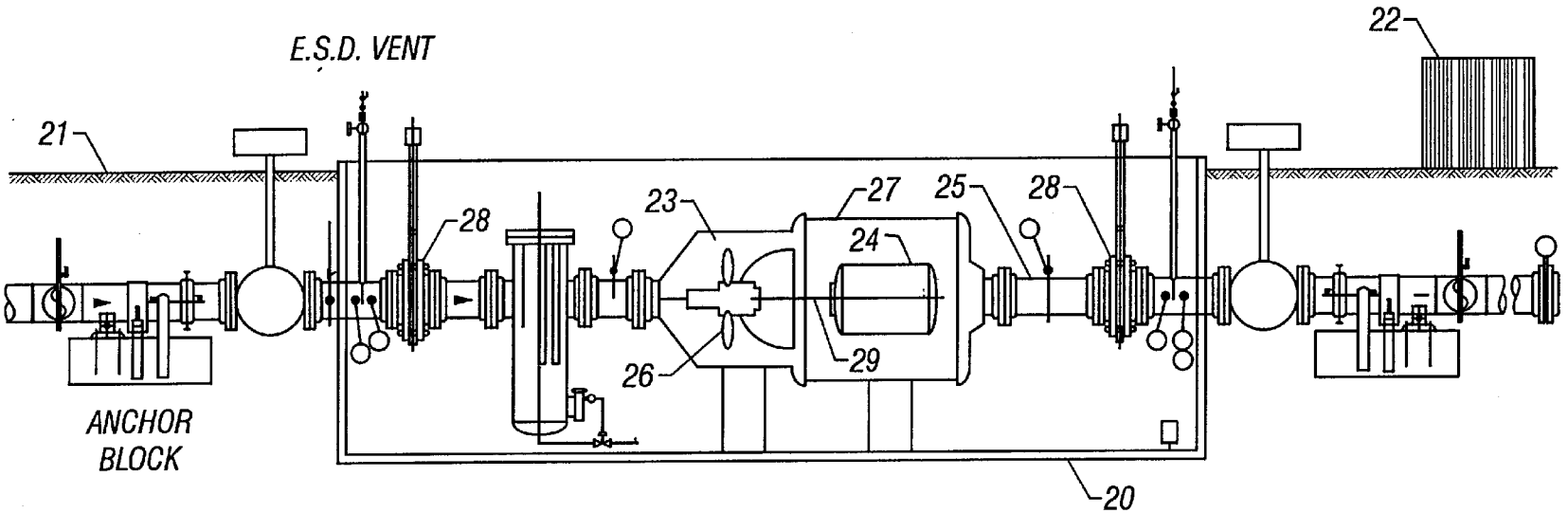
FIG. 1 is an elevation (side) view of an In-line Electric Motor Driven Compressor according to an embodiment of the invention.

Referring to FIG. 1, there is shown an elevation view of an In-line Electric Motor Driven Compressor station according to an embodiment of the invention. Although the invention will be described primarily with respect to natural gas compressor stations, it will be understood that it is not limited to this application and variations of the invention are easily adapted to air compressors or any compressor system that could benefit from in-line compression.

In this embodiment, the station includes a compressor 23 mounted in a concrete vault 20 that has been buried below ground level 21. The control elements to operate the compressor 23 can be contained in a control building 22 mounted above ground level 21. Alternately, the control elements could be located within the vault 20 as a matter of design choice. The compressor 23, in this embodiment, is an in-line ducted-fan compressor 23. The compressor 23 is run from an air (or gas) cooled motor 24, with which it shares a common shaft 29. The motor 24 can actually be cooled by the flow of gas through the pipeline 25. Suitable air cooled motors are known to those of skill in the art, for example, the Model AMB commercially available from ABB Corporation. The compressor 23 is a fan blade compressor that comprises a plurality of fan blades 26 that direct the flow of gas through the pipeline 25 from left to right in this embodiment.

The gas cooled motor 24 is contained in a cage comprising stiffening bars 27 that prevent damage to the motor 24 due to forces in the pipeline 25. The compressor 23 is joined to the pipeline 25 through conventional joints and valves 28, which are selected as a matter of design choice.

Figure 6B:
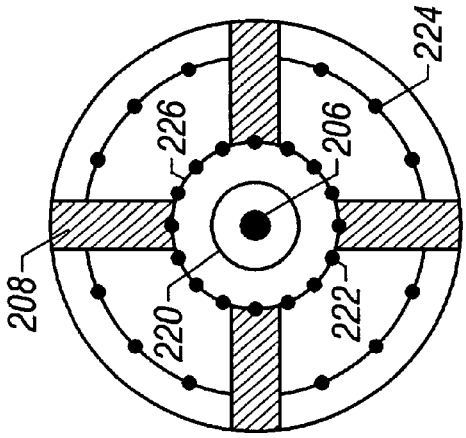
FIG. 6B is a cutaway drawing of the invention shown in 6A from a front, or axial view.
Figure 6A:
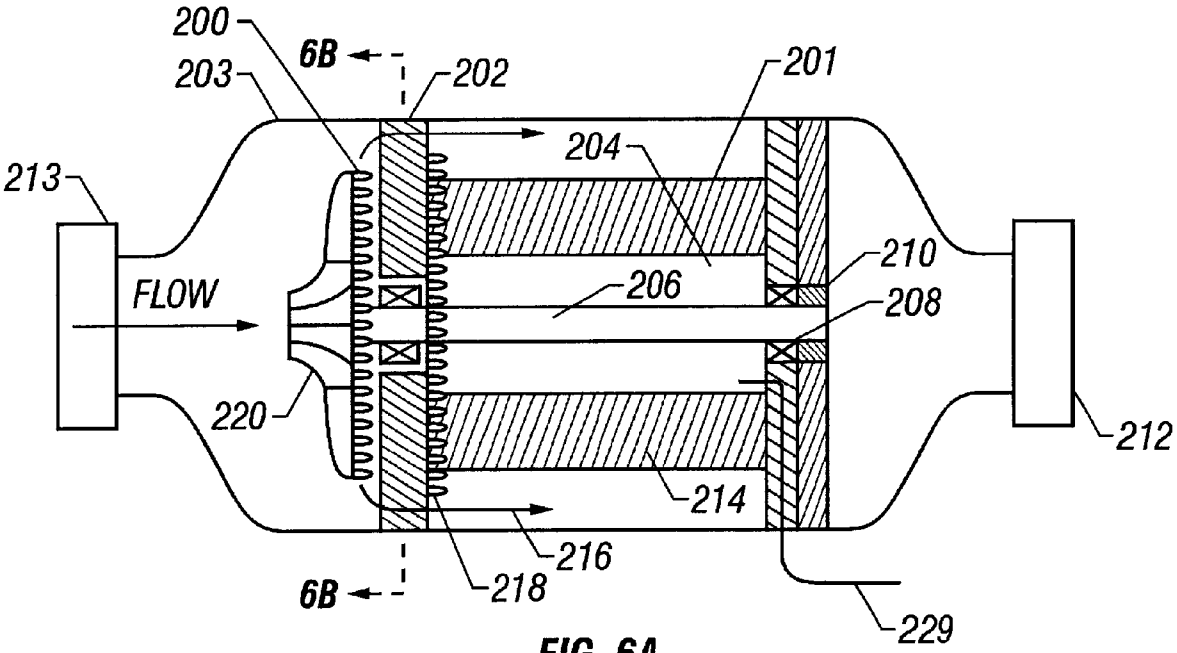
FIG. 6A is a cutaway side view of an IEMDC centrifugal gas compressor according to an embodiment of the invention.

Another suitable embodiment of compressor 23 is a centrifugal wheel compressor. FIG. 6A is a cutaway diagram of a centrifugal wheel compressor according to an embodiment of the invention. FIG. 6B is a cutaway view of FIG. 6A looking along the motor axis. The compressor comprises an electric motor 201 which drives a motor shaft 206. The motor shaft 206 preferably rests on magnetic bearings 208 and rundown bearings 210 which support the motor shaft 206 in the event of failure of the magnetic bearings 208. The motor is housed within a housing body 203 for the gas to flow through that has an intake flange 213 and a discharge flange 212 coupled to the upstream and downstream portions of a gas pipeline (not shown). The direction of gas flow is indicated by the arrows in the figure. As motor 201 turns, it turns motor shaft 206 which in turn spins centrifugal wheel 220. The centrifugal wheel forces gas across the motor 201 which compresses the gas and cools the motor at the same time. The motor is preferably contained in the housing 203 by aerodynamic motor supports 202. These motor supports 202 are preferably fin-shaped to reduce friction of the gas flowing across the motor 201.

Axial guide vanes 218 mounted on axial guide vane ring 224 are also provided to straighten out the flow of gas and keep the flow smooth through the housing. A small portion of the gas is allowed to flow through the motor windings 214 to further cool the motor. Further, a variable diffuser ring 222, on which reside the diffuser vanes 200, may be provided to convert the velocity of the gas to pressure inside the pipeline.

Selection of the centrifugal wheel 220 is a matter of design choice. Preferably, the centrifugal wheel is a closed wheel to minimize recirculation of the gas. However, open wheels may be used a matter of design choice depending on the gas properties and other factors known to those in the art.

In another embodiment, the compressor 23 is an axial flow compressor. As it will be understood by those of skill in the art, an axial flow compressor is similar in many respects to a fan blade compressor, however, the blades are generally shorter in length and mounted in a disk that attaches to the shaft 29.

Figure 7B:
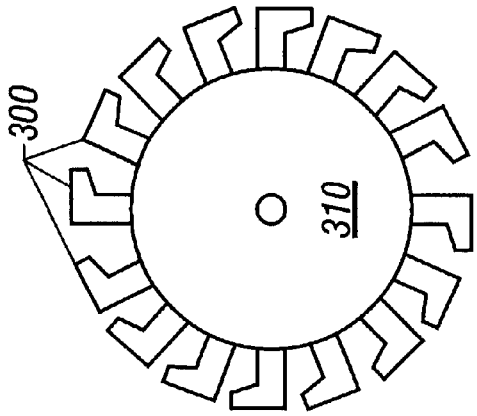
FIG. 7B is a front view of the embodiment of the invention shown in FIG. 7A.
Figure 7A:
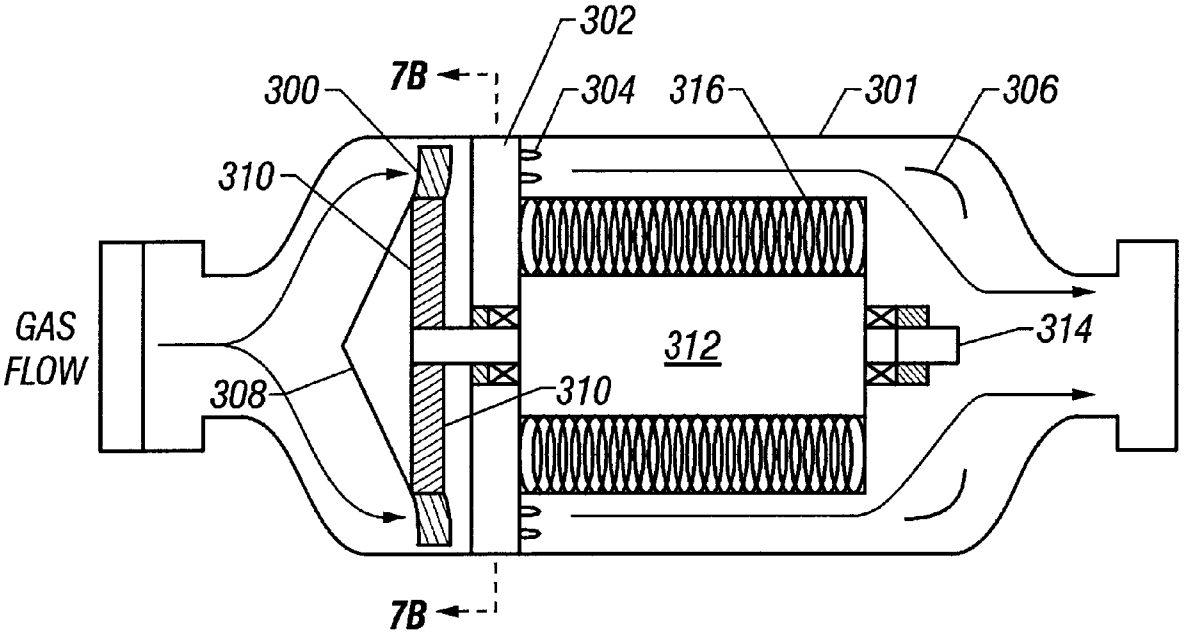
FIG. 7A is a IEMDC single staged axial flow compressor according to a further embodiment of the invention.

FIG. 7A is a cutaway diagram of a single-staged axial flow compressor according to an embodiment of the invention. The compressor is similar to the centrifugal gas compressor system shown in FIG. 6. It comprises a motor 312 with motor windings 316 that drives a shaft 314. The motor 312 is mounted into the housing 301 by means of motor supports 302. Again, motor supports 302 are preferably aerodynamic in shape to reduce friction of the gas moving across the motor 312. The housing is provided with an inlet and outlet to allow gas flow through the housing as indicated by the arrows. The shaft 314 of motor 312 is connected the compressor disk 310. The compressor disk 310 comprises a metal disk with a nose cone 308. The outer rim of the disk 310 contains a plurality of axial flow compressor blades 300 which compress the gas and force it through the housing 301. FIG. 7B is a front view of a portion of the compressor disk 310 showing the plurality of compressor blades 300.

Figure 2:
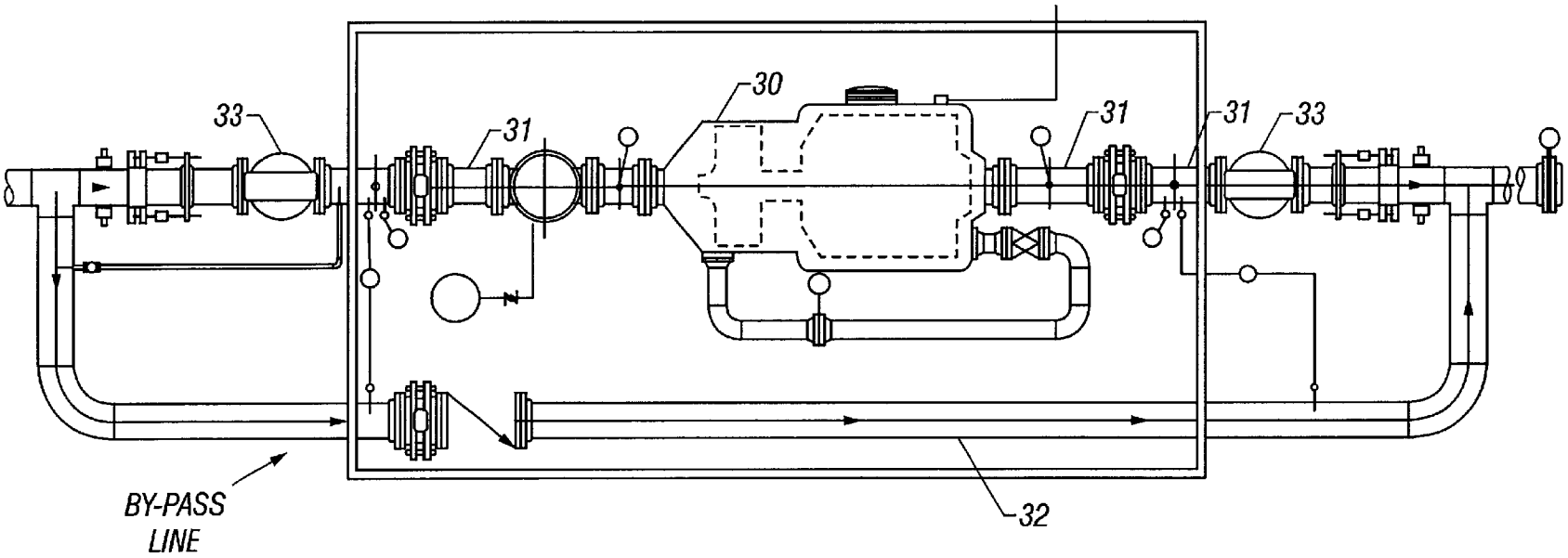
FIG. 2 is a plan (top view) of an In-line Electric Motor Driven Compressor according to a further embodiment of the invention.

FIG. 2 is a plan top view showing another embodiment of the invention. A bypass line 32 is provided to bypass the In-line Electric Motor Driven Compressor 30 to allow for maintenance of the compressor 30 without the need to shut down gas flow through the pipeline 31. Blocked valves 33 are used to isolate the in-line compressor 30 from the flow of gas through the pipeline 31 while maintenance is being performed. The valving required to establish the bypass line 32 is conventional in the art. The embodiments shown in FIGS. 1 and 2 depict the use of a single stage axial compressor. The single-stage compressor, in this embodiment, has a single centrifugal compressor wheel mounted upstream of the motor. Gas is drawn into the wheel and slung out by the vanes as the wheel rotates. Pressurized gas leaving the single stage compressor will be forced through and around the electric motor and then into the pipeline.

Figure 8:
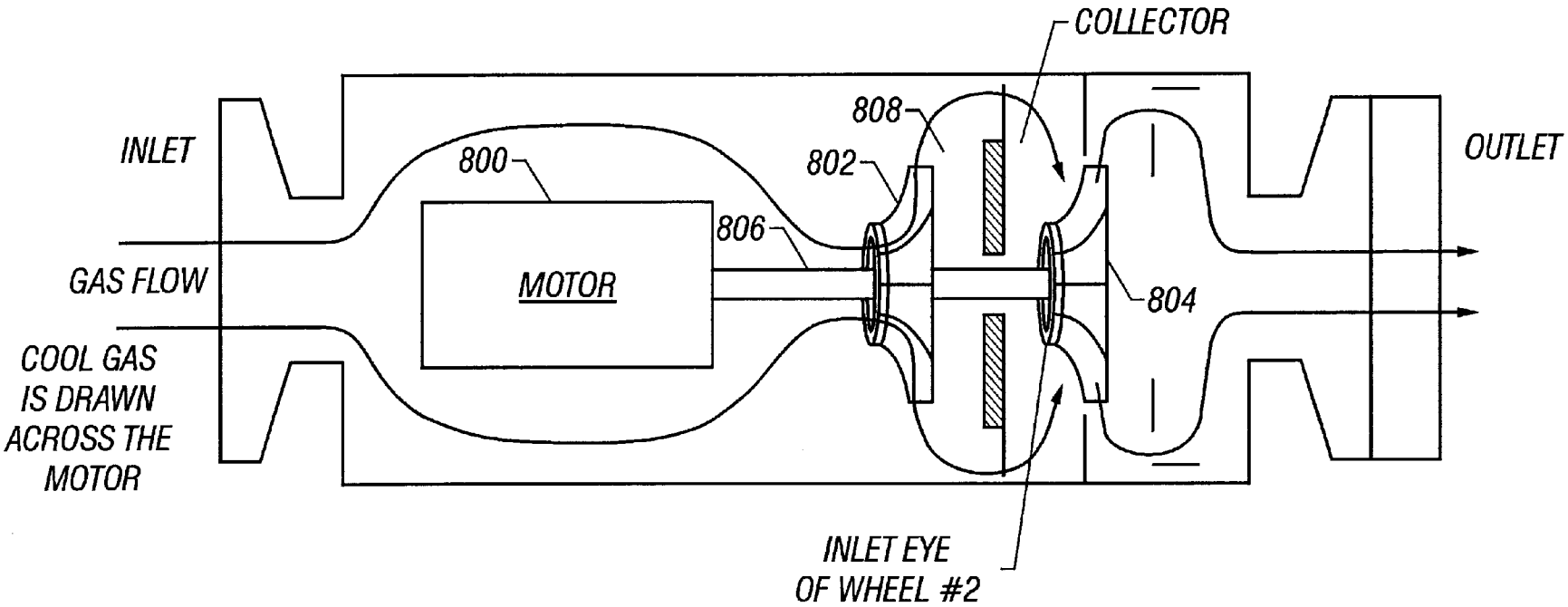
FIG. 8 is a cutaway side view of an IEMDC two-stage centrifugal compressor according to still a further embodiment of the invention.

In other versions of the IEMDC, the motor may be placed upstream (low pressure side) of the compressor wheels and gas will be drawn across the motor by two or more wheels comprising a two or more stage compressor. FIG. 8 is a cutaway view of a two-stage embodiment of the invention. The two-stage compressor uses the motor 800 upstream to rotate two different sized wheels 802, 804 downstream. The wheels 802, 804 are also mounted on the motor shaft 806. The wheel closest to the motor, i.e., wheel 802, will have a larger inlet as it draws in gas that is less dense and accelerates in though its internal passages. After leaving the first wheel 802 (first stage) the gas passes through a diffuser 808 where its velocity is converted into pressure. The gas is collected and directed into the inlet of the second wheel 804 (second stage, which has a smaller diameter inlet eye because the gas is denser due to the pressure increase) where the gas is accelerated through the second wheel 804 and exits to an axial diffuser and finally returns to the pipeline (not shown). The number of stages provided is a matter of design choice.

Figure 3:
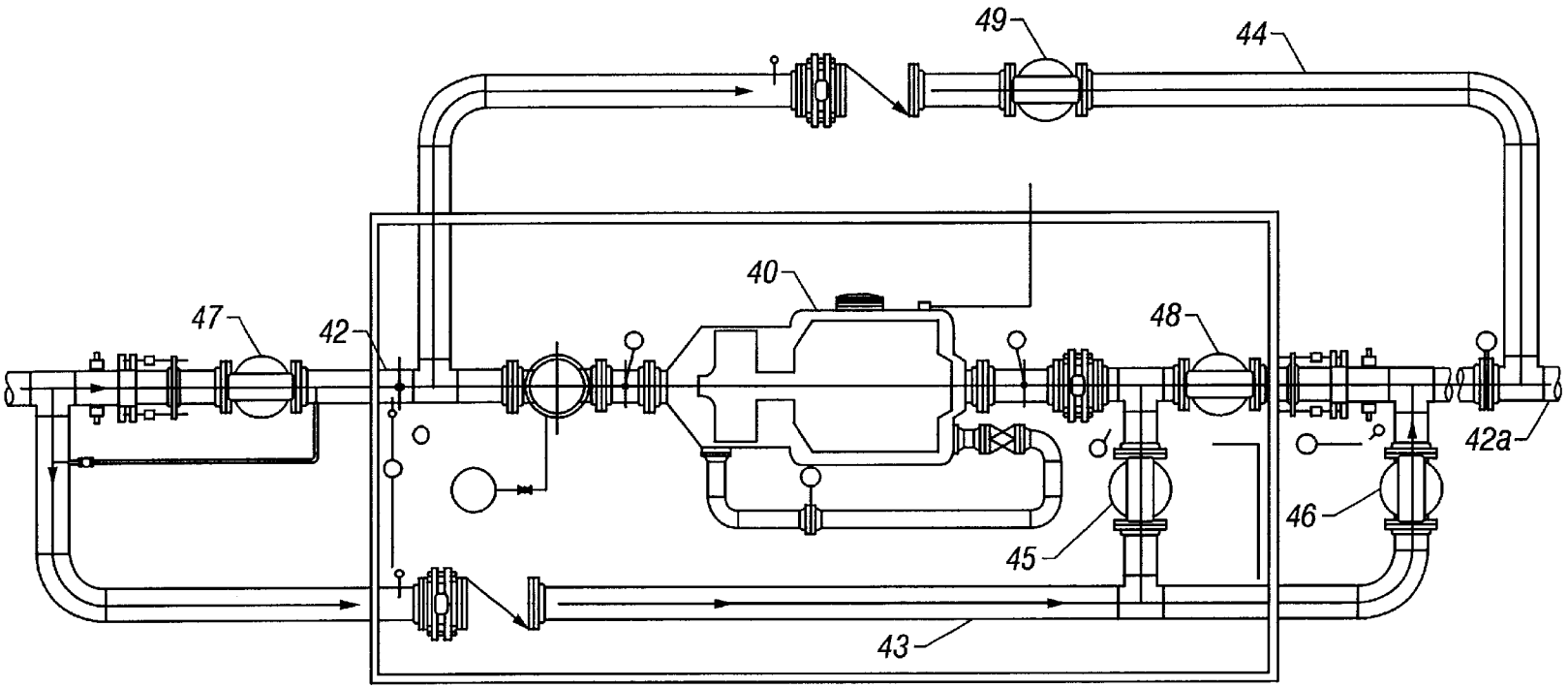
FIG. 3 is a plan (top view) of an In-line Electric Motor Driven Compressor with a Reverse Flow Option according to a further embodiment of the invention.

FIG. 3, shows a plan top view of another embodiment of the invention using a centrifugal compressor wheel 40. It will be noted that the centrifugal compressor 40 is in-line with the pipeline 42. A plurality of additional bypass ducts 43 and 44 are provided in order to allow the centrifugal compressor 40 to reverse itself to generate electrical power when the compressor 40 is not being used to maintain pressure in the pipeline 42. In this configuration, the bypass line 43 is reconnected to the pipeline 44 through two separate block valves 45 and 46. For maintenance purposes, the block valves 47 and 45 are closed and the block valve 46 is open. This allows gas flow from left to right through the pipeline 42*a*. When the system operates to compress the gas in the pipeline, the block valve 47 is open and block valves 45 and 46 are closed, thus allowing gas to flow from left to right through the compressor 40 along the pipeline 42. To reverse the flow of gas through the compressor 40 to generate electricity and resupply the power grid the block valve 47 must be closed; the block valve 46 must be closed; the block valve 45 must be opened; and the block valve 48 must be closed. In this embodiment, gas flows through the bypass line 43 and the block valve 45 and reenters the compressor 40 from the opposite direction compared to ordinary flow. The compressor 40 turns in the opposite direction, thus generating electricity. By routing the gas through the block valve 49 in the bypass line 44, the gas rejoins the pipeline 42 at a section 42A. Therefore, although the flow of natural gas through the compressor 40 is reversed, the flow through the pipeline 42 continues in the left to right direction.

Figure 4:
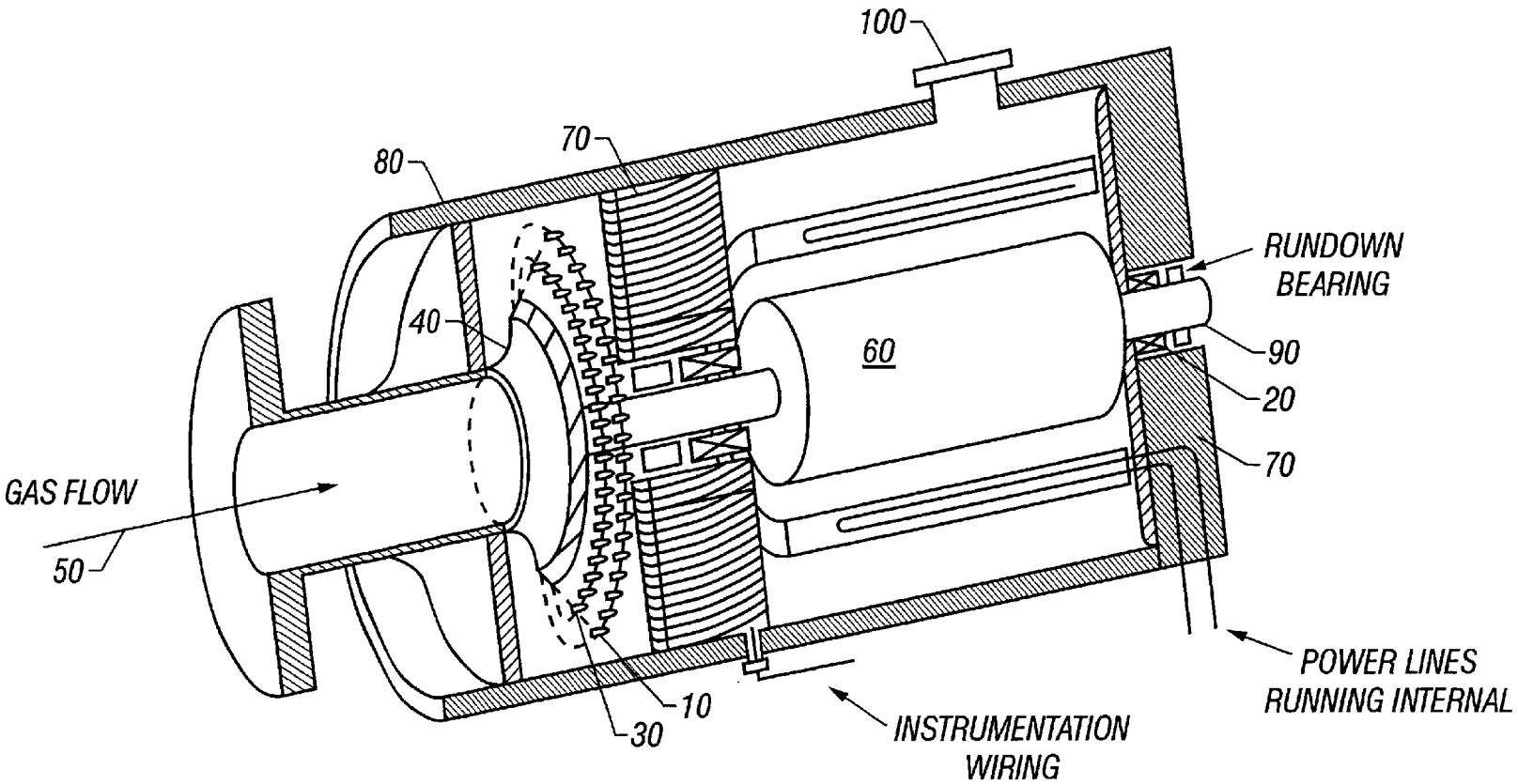
FIG. 4 is a cut-away view of an In-line Electric Motor Driven Compressor according to a further embodiment of the invention.
Figure 5:
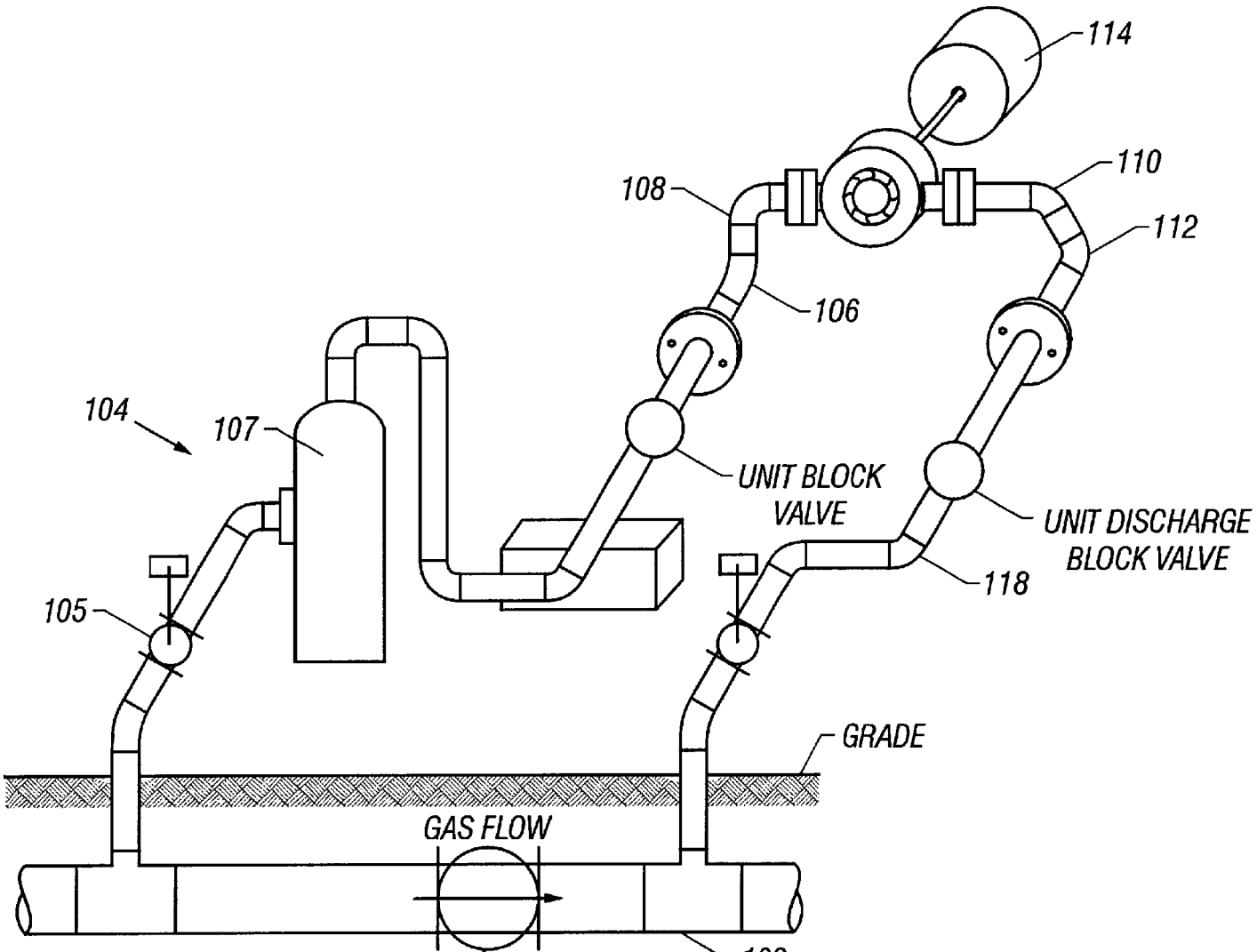
FIG. 5 is a diagram of a conventional compressor station.

FIG. 4 is a cut away view of a compressor suitable for use according to an embodiment to the invention. In this case, the compressor comprises a plurality of magnetic rotor bearings 20, a plurality variable diffuser vanes 30, a plurality of axial diffuser vanes 10, an axial inlet 50, a casing 80, a motor support 70, and a gas cooled motor generator 60. The casing 80 is stiffer than conventional compressor cases so that it can withstand the increased pressure in the pipeline as gas flows through the compressor. Any deflection in the casing 80 could result in damage to the compressor or the motor. Preferably, the IEMDC compressor case, or housing, will be capable of withstanding axial forces at least two times greater than conventional compressor cases. To this end, the case of the IEMDC may be fabricated from steel plate that is at least two times the thickness (greater than 2") of the connecting pipeline piping. Pipelines are generally less than 1" in wall thickness. Preferably, the IEMDC case is designed to be in tension when installed to resist distortion. The conventional compressor cases may be cast from iron or fabricated from steel.

Conventionally fabricated compressors have inlet and outlet nozzles in which at least one of the nozzles is perpendicular to the gas flow and the compressor shaft. Therefore, an axial load on a. conventional compressor case causes a moment. The moment on a conventional compressor case causes either the case to deflect or misalignment between the driver and the compressor, resulting in bearing, motor, nozzle or seal failure.

In the IEMDC, the driver (motor) and the compressor wheel are mounted on a common shaft inside the case. Thus, an axial load imparts a compressive force on the IEMDC that can be evenly distributed over the entire case. The common shaft is preferably levitated in the magnetic field of the magnetic bearings and thus no loads are transmitted to the compressor or motor rotor to cause a misalignment. In general the IEMDC case should be designed to withstand between 1000 psig and 1500 psig when used in a natural gas compression station application. The thickness of the case can be easily increased to make the unit capable of withstanding higher operating pressures.

Referring again to FIG. 4, heat from the motor is transmitted through the motor support 70 to a cage 90 that holds the motor in place. The cage 90 is separated from the casing 80 so that any compressive load placed on the casing 80 by the pressure of the gas flowing through the pipeline will not be transmitted to the cage 90, which could deflect and cause damage to the system. The motor supports 70 are designed to transmit heat from the motor to the cage 90 and allow the flowing gas to cool the compressor.

The axial diffuser vanes 10 are designed such that their positions may be adjusted to allow the compressor wheel to spin in either direction so the compressor may generate electricity. Various methods for changing the pitch on the axial diffuser vanes 10 are known to those of skill in the art. For example, the vane system used in the IEMDC can be substantially similar to the system used by General Electric Corp. ("GE") in their GE Frame 3 two-shaft gas turbine. GE's variable position second stage nozzles are located upstream of the low-pressure turbine. An electrically actuated positioner drives a connecting rod that in turn forces a ring to rotate. Each vane is connected to the ring and turns about its own axis. In another variation, the invention may employ A–C Compressors Corporation's Model DH3M, which features variable inlet vanes. However, it is important to understand that typical variable pitch diffuser vanes may have a limited range of motion that is insufficient to cause the motor shaft to spin in both directions efficiently. Both the inlet and outlet vanes need to be positionable depending on the direction of the motor's spin so that the compressor can also run in an electric generation mode.

In one advantageous version of the invention, the IEMDC is controlled by an Integrated Gate Commutated Thyristor (IGCT) variable frequency drive provided by ABB. This allows control to be performed by the ABB developed Direct Torque Control (DTC) to simultaneously incorporate high performance flux control and direct control of motor torque. The result is sensorless flux vector control that provides torque and speed control. ABB's ACS 600 drive line is an exemplary DTC Control System. Another is the ACS 1000 which extends DTC into the medium voltage market, 4000–6000 V. The advantages offered by DTC also provide the basis upon which other performance related features such as full torque at zero speed, power loss ride-through and automatic start are built. The ACS includes the necessary power conditioning equipment including PLC type controllers and transformers.

The ABB Variable Frequency Drive is capable of modifying the power frequency to and from the motor and can isolate the motor electrically from the power grid. In one particular embodiment, two of the currently available 5 MW ASC 1000s can placed back to back, i.e., in parallel, to serve as the power converter for the IEMDC.

Preferably, the compressor casing is designed to handle higher axial loads than typical gas compressors. The axial loads may be two or more times higher than in conventional systems because the IEMDC is installed directly into the pipeline hence all pipeline loads could be transmitted to the IEMDC. The majority of the load will not be transmitted to the IEMDC because the concrete blocks supporting the anchor flanges will restrain any pipe movement. Preferably, the case will have sufficient wall thickness and yield strength to resist distortions greater than 0.125". Units with this stronger compressor casing will not misalign like conventional motor drive units because the rotating components are internally supported and remain seated in this specially designed cage arrangement. Furthermore, the compressor diffuser vanes may be adjustable using an electromechanical vane system known to those with skill in the art. In another embodiment, the motor supports are designed to resemble an airplane wing with a wide chord and a tapering trailing edge. This design also provides a better path for the power lines feeding (through the center axis of the vane as shown in FIG. 6A by power lines 229) the motor as well as serving as flow straightening vanes to prevent losses in the pipeline. Additionally, it is important to consider compressor stations may have to operate in wet environments or operate in completely submerged environments for brief periods of time. Finally, the power converter/control system may be designed to backfeed power to the power grid in order to take advantage of the reversing feature of the In-line axial compressor.

Figure 9:
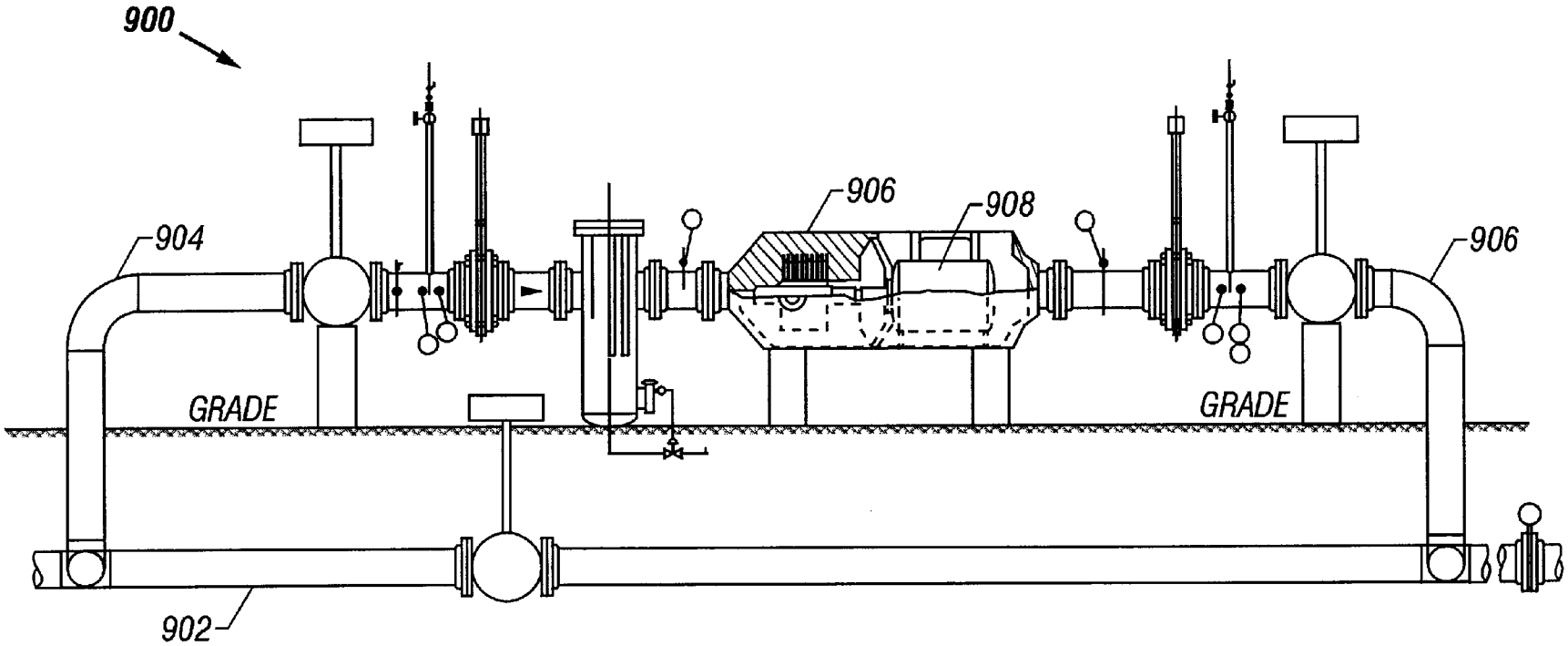
FIG. 9 is a cutaway view of an above ground natural gas compression station according to an embodiment of the invention.

Still a further embodiment of the invention is shown in FIG. 9. FIG. 9 depicts an above ground natural gas compression station 900. The gas pipeline 902 is coupled to a suction header that allows gas flow through a 90 degree rolled elbow 904 and into an in-line axial compressor 906 driven by motor 908. The gas is compressed and returned to the pipeline 902 through elbow 906 in the discharge header.

Having described the invention above, various modifications of the techniques, procedures, material and equipment will be apparent to those in the art. It is intended that all such variations within the scope and spirit of the appended claims be embraced thereby.

I claim:

1. An in-line compressor comprising:

a housing axially connectable to piping through which a gas flows;

an electric motor having a shaft mounted in-line with a bi-directional gas flow through the housing;

a compressor that is mounted axially in-line with the shaft of the electric motor;

wherein the motor is adapted to drive the compressor so that the compressor compresses the gas in the piping.

2. An in-line compressor as in claim 1 wherein the compressor comprises a ducted-fan compressor.

3. An in-line compressor as in claim 1 wherein the compressor comprises an axial-flow compressor.

4. An in-line compressor as in claim 1 wherein the compressor comprises a centrifugal wheel compressor.

5. An in-line compressor as in claim 1 wherein the compressor and motor share a common shaft.

6. An in-line compressor as in claim 1 wherein the compressor is adapted to use gas flow through the piping to drive the electric motor so that the electric motor operates as a generator and generates electrical power.

7. An electric motor driven compressor station comprising:

a first piping connection joining an input to the compressor with a first section of a natural gas pipeline;

a second piping connector joining the output of the compressor to a second section of the natural gas pipeline;

wherein the compressor includes a shaft that is in-line with a shaft of an electric motor and gas flows, in a direction in-line with the compressor shaft, from the first section of the natural gas pipeline into the compressor where it is compressed and subsequently passed into the second section of the natural gas pipeline.

8. An electric motor driven compressor station as in claim 7 wherein the electric motor is gas cooled.

9. An electric motor driven compressor station as in claim 8 wherein the electric motor support is aerodynamically non-intrusive.

10. An electric motor driven compressor station as in claim 7 wherein the compressor is an in-line electric motor compressor.

11. An electric motor driven compressor station as in claim 10 wherein the compressor comprises axial diffuser vanes that are adjustable with respect to the flow of gas through the pipeline so that gas flow through the pipeline drives the compressor and the compressor, in turn, drives the electric motor so that the electric motor operates as a generator and generates electrical power.

12. An electric motor driven compressor station as in claim 11 wherein the axial diffuser vanes can be rotated using an electro-mechanical vane system.

13. An in-line electric motor driven compressor station as in claim 7 further comprising a bypass line and a plurality of block valves.

14. An in-line electric motor driven compressor station as in claim 7 wherein the motor generator is linked to a power converter control system to generate electricity.

15. An electric motor driven compressor station as in claim 7 wherein the compressor is a one-stage axial compressor.

16. An electric motor driven compressor station as in claim 7 wherein the compressor is a centrifugal compressor.

17. An electric motor driven compressor station as in claim 7 wherein the anchor block and flanges are adapted to restrain the pipeline into or away from the compressor.

18. An electric motor driven compressor station as in claim 7 wherein the compressor is contained in an underground vault.

19. An electric motor driven compressor station for gas pipelines comprising:

an in-line compressor having an axial shaft;

a gas-cooled electric motor having an axial shaft, the axial shaft of the electric motor being axially coupled to the axial shaft of the compressor;

a piping arrangement that allows gas to flow from the pipeline through the compressor and electric motor and back into the pipeline, wherein the gas flow through the compressor and electric motor is bi-directional and in-line with the axial shafts of the electric motor and the compressor; and wherein the electric motor and compressor are adapted so that when gas flows in a first direction through the pipeline the electric motor drives the compressor thereby compressing the gas, and when gas flows in a second direction through the pipeline the gas flow drives the compressor which, in turn drives the electric motor thereby causing the electric motor to operate as a generator and generate electricity.

* * * * *